US005252232A

United States Patent [19]

Vinod

[11] Patent Number: 5,252,232

[45] Date of Patent: Oct. 12, 1993

[54] STAIN AND SOIL RESISTANT COMPOSITIONS HAVING FREEZE-THAW STABILITY

[75] Inventor: Yashavant V. Vinod, Hockessin, Del.

[73] Assignee: E. I. Du Pont de Nemours and Company, Wilmington, Del.

[21] Appl. No.: 763,021

[22] Filed: Sep. 20, 1991

[51] Int. Cl.[5] ..... D06M 13/16; D06M 15/41

[52] U.S. Cl. ..... 252/8.6; 252/8.7; 8/115.56; 8/115.54; 8/557; 8/560; 8/DIG. 21

[58] Field of Search ..... 8/115.56, 115.54, 557, 8/560, DIG. 21; 252/8.6, 8.7

[56] References Cited

U.S. PATENT DOCUMENTS 4,029,585 6/1977 Dettre et al. .

4,388,372 6/1983 Champaneria et al. ..... 428/395

4,883,839 11/1989 Fitzgerald et al. .

4,925,707 5/1990 Vinod .

FOREIGN PATENT DOCUMENTS 329899 8/1989 European Pat. Off. .

OTHER PUBLICATIONS

U.S. Ser. No. 07529, 1976, Pugh et al.

*Primary Examiner*—Olik Chaudhuri

*Assistant Examiner*—C. Everhart

[57] ABSTRACT

The present invention relates to an improved process for preparing a stain and soil resistant aqueous (non-solvent) composition. The resulting composition demonstrates effective freeze-thaw stability.

4 Claims, No Drawings

STAIN AND SOIL RESISTANT COMPOSITIONS HAVING FREEZE-THAW STABILITY

BACKGROUND OF THE INVENTION

1. Field of the Invention

The present invention relates to an improved process for preparing a composition which is capable of imparting stain and soil resistance to installed nylon carpets. More particularly, the invention involves adjusting the pH of an aqueous based (non-solvent) dispersion to a final level of about 4.2 to 4.6. The resulting aqueous (non-solvent) dispersion demonstrates effective freeze-thaw stability.

2. Description of the Related Art

Polyamide substrates, such as nylon carpeting, upholstery fabric, etc. are subject to staining by a variety of agents, such as food and beverages. Those skilled in the art have developed different chemical compounds for making these substrates more stain resistant.

For example, Fitzgerald et al., European Patent Application Publication No. 329,899, discloses treating such polyamide substrates with stain-resistant compositions comprising hydrolyzed ethylenically unsaturated aromatic/maleic anhydride polymers. A copolymer prepared from styrene and maleic anhydride is disclosed as the preferred compound.

These stain-resist, or stain-blocker, agents are distinguished from fluorochemicals which are primarily used to impart soil resistance to textile fibers. Dettre et al., U.S. Pat. No. 4,029,585, discloses applying an aqueous fluorochemical dispersion containing a perfluoroalkyl ester of a carboxylic acid of from 3 to 30 carbon atoms to textile substrates, followed by drying. As a result, the fibers are imparted with a coating that is resistant to dry soiling and does not propagate a flame.

As disclosed in Vinod, U.S. Pat. No. 4,925,707, it is also known to use such fluorochemicals in combination with a stain-blocker agent, such as a hydrolyzed styrene/maleic anhydride copolymer. An aqueous dispersion of the stain and soil-blocking agents may be formed and applied to carpets. More particularly, Vinod discloses applying the composition to a nylon carpet that is installed. This is opposed to immersing the carpet or otherwise treating the precursor nylon polymer or fibers earlier during a manufacturing process.

Conventional fluorochemical dispersions contain solvents, such as 2-butoxyethanol, and isopropyl alcohol, but such solvent-based dispersions, when applied to carpets, may have environmental disadvantages. However, when most aqueous-based (non-solvent) fluorochemical dispersions are stored under freezing conditions and subsequently thawed, they show phase separation, become difficult to apply, and are non-effective. Such freezing conditions may occur during the winter, when the compositions are transported in unheated trucks and stored in unheated areas.

Therefore, it would be desirable to produce an aqueous (non-solvent) dispersion containing a soilblocker fluorochemical dispersion and stain-blocker solution which has effective "freeze-thaw stability." In accordance with this invention, the aqueous dispersion has effective "freeze-thaw stability", if the dispersion doesn't show precipitation, phase separation, or excessive turbidity. The present invention provides an improved process for producing an aqueous dispersion containing an aqueous fluorochemical dispersion and a solution of hydrolyzed styrene/maleic anhydride copolymers. The aqueous based (non-solvent) total dispersion demonstrates effective freeze-thaw stability.

SUMMARY OF THE INVENTION

The present invention relates to an improved process for preparing a composition which is capable of imparting stain and soil resistance to installed nylon carpets. The composition demonstrates effective freeze-thaw stability, without using solvents. Generally, the process involves forming an aqueous (non-solvent) dispersion comprising a ratio by weight percent of an aqueous dispersion of perfluoroalkyl ester of citric acid to a solution of hydrolyzed styrene/maleic anhydride copolymer in the range of about 10:1 to 1:1. The key improvement involves adjusting the pH level of the total dispersion to a final level of about 4.2 to 4.6, and preferably to 4.4

In a preferred embodiment, the aqueous dispersion comprises a ratio of an aqueous dispersion of perfluoroalkyl ester of citric acid to a solution of hydrolyzed styrene/maleic anhydride copolymer of 9.8 to 1.

The invention also includes applying the composition to an installed nylon carpet, whereby stain and soil resistance are imparted to the carpet.

DETAILED DESCRIPTION OF THE INVENTION

The present invention relates to a process for preparing an aqueous dispersion having effective freeze-thaw stability. These dispersions may be applied to installed nylon carpets in order to increase the stain and soil resistance of the carpets.

The solution of hydrolyzed styrene/maleic anhydride copolymer (stain-blocking agent), suitable for this invention, may be prepared by techniques disclosed in U.S. patent application Ser. No. 07/529,076, filed May 25, 1990, the disclosure of which is hereby incorporated by reference. Generally, the styrene/maleic anhydride copolymers are reacted with aqueous alkaline materials to form clear, lightly-colored solutions of styrene/-maleic anhydride copolymers. The reaction is carried out at a temperature above 100° C. and a pressure above atmospheric in equipment suitable for pressure operation.

Initially, the styrene monomer is copolymerized with the maleic anhydride by techniques known in the art to produce a styrene/maleic anhydride copolymer having a number average molecular weight in the range between about 500 and 4000. Preferably, a copolymer containing styrene and maleic anhydride at a molar ratio of about 1.1 and having a number average molecular weight in the range between about 800 and 2000 is prepared.

The styrene/maleic anhydride copolymer, preferably in flake form, an alkali or alkaline salt, and about 60 to 90% by weight water may then be conveniently charged to a reactor capable of withstanding moderated pressures. The mixture is heated to temperatures above about 100° C. at a pressure in excess of atmospheric, preferably autogenous pressure, until solution is complete. Temperatures between 120° to 140° C. are preferred, because this range affords complete solution in a reasonable length of time. For example, heating a mixture of 1:1 styrene/maleic anhydride copolymer at 125° C. in aqueous caustic soda leads to a lightly colored solution in the course of about two hours.

The aqueous dispersion of perfluoroalkyl ester of citric acid (soil-blocking agent), suitable for this invention, may be prepared by techniques disclosed in Dettre et al., U.S. Pat. No. 4,029,585, the disclosure of which is hereby incorporated by reference. Generally, the perfluoroalkyl ester of citric acid is formed by reacting certain perfluoroalkyl aliphatic alcohols with the citric acid.

In the present invention, the perfluoroalkyl ester is preferably the citric acid urethane. To form such a product, the citric acid ester is modified by reacting the ester with an isocyanate compound, for example, 1-methyl-2,4-diisocyanatobenzene, which reacts with the —OH group of the citric acid ester to form urethane linkages. As disclosed in Dettre et al., the citric acid urethane product has sufficient volatility to be removed at a temperature of about 300° C. and provides good soil repellency.

A dispersion of the fluorinated ester may then be prepared by liquefying the ester with a volatile solvent, such as methyl isobutyl ketone, and dispersing the product in water containing a small amount of an emulsifying surfactant, such as tetraalkylammonium halide. The aqueous dispersion is then blended with an aqueous latex of poly(methyl methacrylate) to make a composition which is extendible in water. The composition is diluted with water to prepare a dispersion suitable for application to nylon carpets, in accordance with this invention.

The key improvement of the present invention is preparing the aqueous dispersion containing the above-described stain and soil-blocking agents at a final pH level of about 4.2 to 4.6, and preferably at a final pH level of 4.4, in order that a dispersion having effective freeze-thaw stability is obtained. The final adjustment of the pH may be achieved by adding various amounts of acids, such as citric acid or acetic acid, or alkaline compounds, such as trisodium phosphate (TSP) or tetrasodium pyrophosphate (TSPP) to the total dispersion of hydrolyzed styrene/maleic anhydride copolymer and perfluoroalkyl ester of citric acid during its preparation. However, it is critical that the amount of acid or alkaline compound added be sufficient to adjust the pH of the total dispersion to a final level of about 4.2 to 4.6. If the final pH level is lower, such as 4.00, or higher, such as 5.00, the resulting dispersion will not demonstrate effective freeze-thaw stability, in accordance with this invention. Rather, the total dispersion will separate into phases, become difficult to apply, and the efficacy of the stain and soil resistance will become diminished.

In a preferred method, the aqueous dispersion is prepared by adding 50% citric acid to a beaker containing water which has been agitated. The hydrolyzed styrene/maleic anhydride copolymer solution and perfluoroalkyl ester of citric acid dispersion are then added to the beaker, followed by agitation for approximately 15 minutes. The final pH of the dispersion is then adjusted to the desired range by adding 50% citric acid (to lower pH) or 10% TSP (trisodium phosphate) solution (to raise pH). The ratio of the aqueous dispersion of perfluoroalkyl ester of citric acid to solution of hydrolyzed styrene/maleic anhydride copolymer by weight percent in the total dispersion should be in the range of about 10:1 to 1:1.

The resulting dispersion containing stain and soil-blocking agents has excellent stability to cold temperatures, and thus can be stored in unheated areas and shipped in unheated trucks. The freeze-thaw stable dispersion may then be applied to an installed nylon carpet by techniques known in the art. These techniques are described by Vinod, U.S. Pat. No. 4,925,707, the disclosure of which is hereby incorporated by reference.

Generally, the dispersion should be applied in such a manner that it penetrates throughout the nylon pile fibers, especially to the base of the pile fibers. For example, an aqueous detergent solution may first be applied to the carpet in order to provide a thorough wetting of the pile fibers, as is done during commercial hot-wet extraction cleaning of an in-place carpet. While the fibers are still in a moist condition, the dispersion containing the stain and soil-blocking agents is applied and preferably mechanically worked into the carpet. This process improves contact of the aqueous dispersion with the pile fibers. It is then important that the treated carpet be allowed to dry in order to develop stain and soil resistance.

It was found that nylon carpet samples treated with the freeze-thaw stable dispersions of this invention, which were frozen, and then thawed, exhibited stain and soil resistance equivalent to nylon carpets treated with the same dispersions which were not frozen and thawed.

Testing Methods

The following procedure was used to evaluate dispersions for freeze-thaw stability. The dispersions were placed in an industrial freezer (such as Model AKT-74-FA, manufactured by Jordon Commercial Refrigeration Co., Philadelphia, Pa.) for a period of 24 hours at a temperature of 3° F. The frozen samples were taken out and allowed to thaw at room temperature (70° F.) for a period of 24 hours and checked for the dispersion stability. The dispersion was termed to have effective freeze-thaw stability if it didn't show precipitation, phase separation, or excessive turbidity.

The foregoing testing methods were used in the following examples. These examples illustrate the present invention but should not be construed as limiting the scope of the invention.

EXAMPLES

EXAMPLE 1

This example shows the effect of pH on the freeze-thaw stability of the carpet soil and stainblocking formulation. A series of dispersions were prepared containing 31.8% of the preferred perfluoroalkyl ester of citric acid (soil-blocking agent) formulation and 3.2% hydrolyzed styrene/maleic anhydride copolymer (stainblocking agent) and water, and the pH was adjusted by adding varying amounts of a citric acid solution. As shown in Table A, only the dispersion having a pH in the range of 4.4±0.2 had effective freeze-thaw stability.

TABLE A

| 50% Citric Acid, gm. | pH | Freeze-Thaw Stable |
|---|---|---|
| 1.6 | 3.45 | NO |
| 0.7 | 4.00 | NO |
| 0.5 | 4.40 | YES |
| 0.3 | 5.00 | NO |
| 0.1 | 5.60 | NO |

EXAMPLE 2

The ratio of the fluorochemical aqueous dispersion of perfluoroalkyl ester of citric acid ("FAD") to the solution of hydrolyzed styrene/maleic anhydride copolymer ("HSMAC") also affects freeze-thaw stability, as shown in Table B, wherein the ratio of these ingredients was varied in a series of aqueous dispersions which were tested for freeze-thaw stability. All dispersions had pH values in the preferred range.

TABLE B

| % "FAD" | % "HSMAC" | Ratio | pH | Freeze-Thaw Stable |
|---|---|---|---|---|
| 24.4 | 0.73 | 33.4 | 4.40 | NO |
| 24.4 | 1.22 | 20.0 | 4.39 | NO |
| 24.4 | 2.50 | 9.8 | 4.38 | YES |
| 24.4 | 9.90 | 2.5 | 4.40 | YES |
| 24.4 | 24.40 | 1.0 | 4.41 | YES |

EXAMPLE 3

A series of aqueous dispersions containing a variety of stain and soil blocking ingredients were also evaluated for freeze-thaw stability. All dispersions contained 24.4% of a soil blocking agent and 2.5% of a stain blocking agent, and the pH was adjusted to the preferred range. The freeze-thaw performance is given in Table C.

TABLE C

| Stain Blocker | Soil Blocker | pH | Freeze-Thaw Stable |
|---|---|---|---|
| "HSMAC" | "FAD" | 4.38 | YES |
| Mobay 40556D* | " | 4.40 | NO |
| FX-661 Stain Resist (3M Co.)* | " | 4.42 | NO |
| NB-31-150% (Peach State Labs, Inc.)* | " | 4.41 | NO |
| "HSMAC" | "Zonyl" TC-A | 4.40 | NO |
| "HSMAC" | 50% "FAD"/ 50% "Zonyl" TC-A | 4.40 | NO |

Mobay 40556D* - A stain-blocker agent, available from Mobay Corporation, Pittsburgh, PA.
FX-661 Stain Resist - A stain-blocker agent, available from 3M Co., St. Paul, MN.
NB-31-150% - A stain-blocker agent, available from Peach State Labs Inc., Rome, GA.
"Zonyl" TC-A - An aqueous fluorochemical dispersion, available from E.I. du Pont de Nemours & Co., Wilmington, DE.

EXAMPLE 4

This example shows that other acids can be used in the formulation to achieve good freeze-thaw stability instead of citric acid, as long as the pH is maintained at the specified value. The formulation shown in Table D was prepared and evaluated for freeze-thaw stability.

TABLE D

| | |
|---|---|
| Water | 64.65 gms |
| Acetic Acid | 0.35 gms |
| "HSMAC" | 3.20 gms |
| "FAD" | 31.80 gms |

The solution pH was 4.4±/−0.1. As expected, both the room temperature and freeze-thaw stability were good when acetic acid was used.

I claim:

1. In a process for preparing a composition capable of imparting stain and soil resistance to an installed nylon carpet, said process comprising forming an aqueous dispersion comprising a ratio by weight percent of an aqueous dispersion of perfluoroalkyl ester of citric acid to a solution of hydrolyzed styrene/maleic anhyride copolymer in the range of 10:1 to 1:1, the improvement comprising adjusting the pH level of the total dispersion to a final level of 4.2 to 4.6 to impart freeze-thaw stability to the dispersion.

2. The process of claim 1, wherein the final pH level is 4.4.

3. The process of claim 1, wherein the aqueous dispersion comprises a ratio of an aqueous dispersion of perfluoroalkyl ester of citric acid to a solution of hydrolyzed styrene/maleic anhydride copolymer of 9.8 to 1.

4. The process of claim 1, further comprising the step of applying the composition to an installed nylon carpet, whereby stain and soil resistance are imparted to the carpet.

* * * * *